US006451397B1

(12) United States Patent
Hagen

(10) Patent No.: US 6,451,397 B1
(45) Date of Patent: Sep. 17, 2002

(54) POUCH LABEL

(75) Inventor: Ronald G. Hagen, Larsen, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/571,244

(22) Filed: May 16, 2000

(51) Int. Cl.[7] ..... G09F 3/00

(52) U.S. Cl. ..... 428/40.1; 206/484; 281/2; 281/5; 283/81; 428/41.7; 428/42.1; 428/42.2; 428/121

(58) Field of Search ..... 428/40.1, 41.7, 428/42.1, 42.2, 121; 283/81; 281/2, 5; 206/484

(56) References Cited

U.S. PATENT DOCUMENTS

| | | | | |
|---|---|---|---|---|
| 3,954,543 A | | 5/1976 | Messmer | 156/363 |
| 4,744,591 A | | 5/1988 | Instance | 251/5 |
| 4,946,033 A | | 8/1990 | Conner | 206/233 |
| 5,127,676 A | * | 7/1992 | Bockairo | 428/40.1 |
| 5,261,531 A | | 11/1993 | Nieves | 206/205 |
| 5,664,677 A | | 9/1997 | O'Connor | 206/494 |
| 5,804,271 A | | 9/1998 | Barry | |
| 5,842,324 A | | 12/1998 | Grosskopf et al. | |
| 6,057,019 A | * | 5/2000 | Barry | 428/40.1 |
| 6,139,935 A | * | 10/2000 | Cullen | 428/68 |

FOREIGN PATENT DOCUMENTS

| | | |
|---|---|---|
| EP | 0525530 A2 | 2/1993 |
| EP | 0638890 A1 | 2/1995 |
| FR | 2713147 A1 | 5/1995 |
| GB | 2331062 A | 5/1999 |
| WO | WO8604551 A | 8/1986 |

* cited by examiner

*Primary Examiner*—Nasser Ahmad
(74) *Attorney, Agent, or Firm*—Quarles & Brady LLP

(57) ABSTRACT

Disclosed herein is a pouch label for attaching a sample to an item, such as a product displayed for sale. Before use, the pouch label is supported by a release-coated liner to which a transparent base layer having an adhesive bottom surface is removably adhered. A pouch, defining a sealed envelope containing the sample, is supported by the base layer. A transparent over-laminate with an adhesive bottom surface is adhered to the base layer to secure the pouch to the base layer. The pouch label can be removed from the release liner so as to attach the sample to the display item.

12 Claims, 2 Drawing Sheets

POUCH LABEL

CROSS-REFERENCE TO RELATED APPLICATION

Not applicable.

STATEMENT REGARDING GOVERNMENT SPONSORED RESEARCH OR DEVELOPMENT

Not Applicable.

BACKGROUND OF THE INVENTION

This invention relates to labels, and in particular to labels attaching samples to products, for example, in a retail store.

Consumer products manufacturers typically advertise their goods on television, radio and in newspapers. Companies also often advertise the quality and advantages of their products at the point of purchase. Typically, this is done with signage and personal demonstrations. Another, effective way of advertising, is to provide shoppers with a sample of the product. Samples can by handed out or attached to related or other products made by the same manufacturer or a different manufacturer to be used after the product is purchased.

Finding a suitable means of including a sample with a product can be problematic. The samples can be tied, fastened or adhered to, or contained within, the packaging of the related product. Typically, however, special packaging is required to both contain the sample and advertise its inclusion in the purchase price of the related product. This requires special packaging to be printed, manufactured and assembled, thereby increasing the cost of the related product.

Accordingly, there is a need for a simple and inexpensive means to attach samples to the outside of products or packaging.

BRIEF SUMMARY OF THE INVENTION

The present invention provides a low cost label pouch particularly well-suited for attaching a product sample to a product on display. Specifically, before use, the pouch label is supported by a release-coated liner to which a base layer of the label having an adhesive bottom surface is adhered. A pouch, defining a sealed envelope containing the sample, is supported by the base layer. An over-laminate with an adhesive bottom surface is adhered to the base layer to secure the pouch to the base layer. The pouch label can be removed from the release liner so as to attach the sample to the display item.

The width of the over-laminate is preferably less than the width of the pouch. In one form, the adhesive bottom surface of the over-laminate adheres to the base layer and the pouch. The width of the pouch is less than the width of the base layer. Additionally, the over-laminate and base layer are preferably transparent.

In a preferred form, the present invention provides a product sample display having a product and a sample label. The sample label includes a pouch containing the product sample and a pouch attachment assembly which has a base layer and an over-laminate. The base layer has an adhesive bottom adhered to a label attachment surface of the product. The over-laminate has an adhesive bottom surface adhered to the base layer on opposite sides of the pouch to secure the pouch to the base layer.

Thus, the present invention provides a simple pouch label that can be used to easily attach product samples to items, such as products on display for sale. The adhesive of the base layer stays with the base layer after it is removed from the release liner so that the label can be adhered to an item. The pouch can be removed from the label by removing the entire assembly from the product, including the base layer, or by peeling back or tearing the over-laminate without removing the base layer from the item. The label is comprised of common stock self-wound polymeric films and paper liners, and the labels can be assembled in a continuous line manner, thereby making the pouch label inexpensive to produce and able to be automatically applied. Moreover, the base layer and over-laminate are transparent so as not to cover graphics on the pouch or the item to which it is attached. Additionally, the invention provides for a product sample display in which product samples are contained in the pouch label and adhered directly to the product or product packaging.

The foregoing and other advantages of the invention will appear from the following description. In this description, reference is made to the accompanying drawings which form a part hereof and in which there is shown by way of illustration preferred embodiments of the invention. These embodiments do not represent the full scope of the invention. Thus, the claims should be looked to in order to ascertain the scope of the invention.

DETAILED DESCRIPTION OF THE PREFERRED EMBODIMENTS

Figure 1:
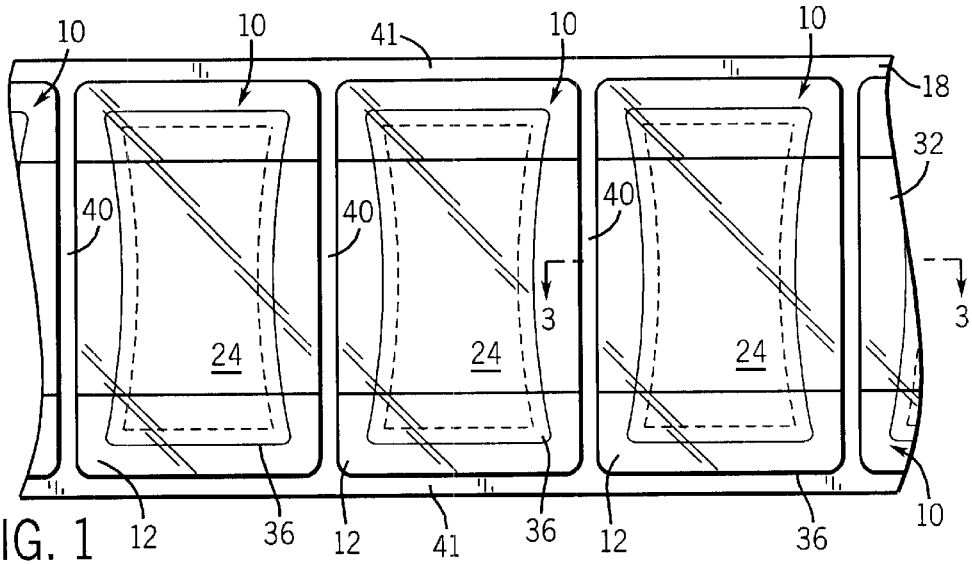
FIG. 1 is a top plan view of three pouch labels of the present invention shown carried on a continuous sheet of release liner.
Figure 3:
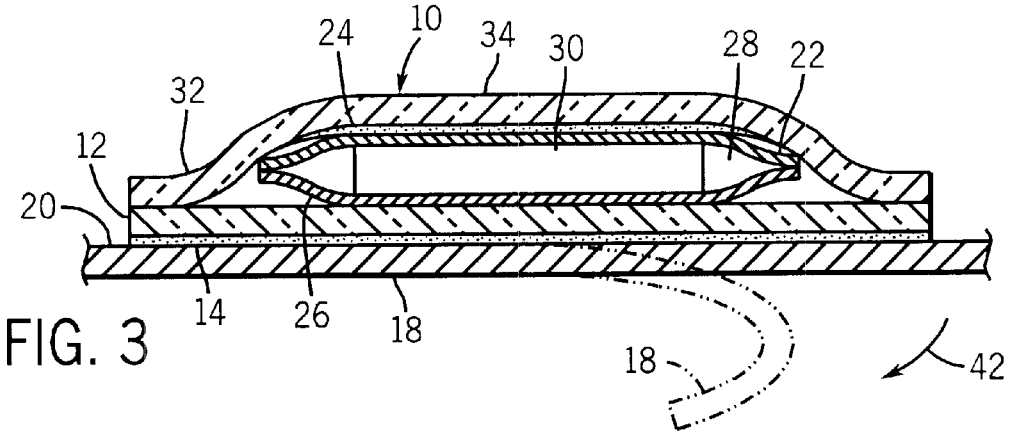
FIG. 3 is an end cross-sectional view taken along line 3—3 of FIG. 1, showing the layers of a pouch label and a phantom release liner being peeled away from a pouch label.

Referring to FIG. 1, a label of the present invention is referred to generally by reference numeral 10. Referring to FIGS. 1 and 3, the label 10 includes a base layer 12. The base layer 12 having an adhesive bottom side 14 coated with a suitable removable or permanent pressure-sensitive adhesive. The bottom side 14 of the base layer 12 is adhered to a release liner 18 having release surface 20. The base layer 12 supports a sealed pouch 22 having front 24 and back 26 panels of lesser size than the base layer 12 and suitably sealed at their edges to define an enclosed cavity 28. The front 24 and back 26 panels may be a foil material having identification indicia printed on their outer surfaces. The enclosed cavity 28 of the pouch 22 contains a product sample 30 of suitable size and shape, for example, a towelette saturated with a cleaning, coating or treatment solution. An over-laminate 32 has a removable or permanent adhesive bottom side 34 which adheres to the front panel 24 of the pouch 22 and to the base layer 12 along the sides of the pouch 22 to secure the pouch 22 to the base layer 12. The over-laminate 32 is preferably of a lesser width than the pouch 22 so that the pouch 22 can be grasped by its corners 36 (see FIG. 1). The over-laminate 32 is sized so that it adheres to the base layer 12 and the pouch 22.

The over-laminate 32 is preferably a 0.001 inch thick transparent self-wound polypropylene having a pressure-sensitive adhesive, commercially available as Faslam #7836. The base layer is preferably made of a transparent film of polystyrene, preferably 0.002 inches thick, and is supplied backed with the release liner, with B-91 pressure sensitive adhesive. The release liner 18 is preferably a 58 pound liner with an R924 release value providing a relatively tight release of the base layer 12.

Referring to FIG. 1, the label 10 can be formed using a self-wound stock of over-laminate 32 and a wound reel of the base layer 12 backed with the release liner 18 so that multiple labels 10 can be made as a web of any suitable length. Specifically, the release e liner 18 and base layer 12 are unwound from a reel with the base layer 12 facing upward. Then, pouches 22 are spaced apart and aligned side-by-side on the base layer 12 and a narrower layer of over-laminate 32 is unrolled and adhered at the adhesive bottom side 34 to the pouches 22 and the base layer 12. The base layer 12 and over-laminate 32 are then cut down to the release liner 18 around the edges of the base sheet 12. This produces a waste matrix which is stripped from the release liner 18, to produce the individual labels 10 spaced apart by spaces 40, and spaced inwardly from the edges of the release liner 18 by the spaces 41. If desired, the release liner 18 can also be cut to create separate labels 10 each with a release liner 18 backing.

Figure 2:
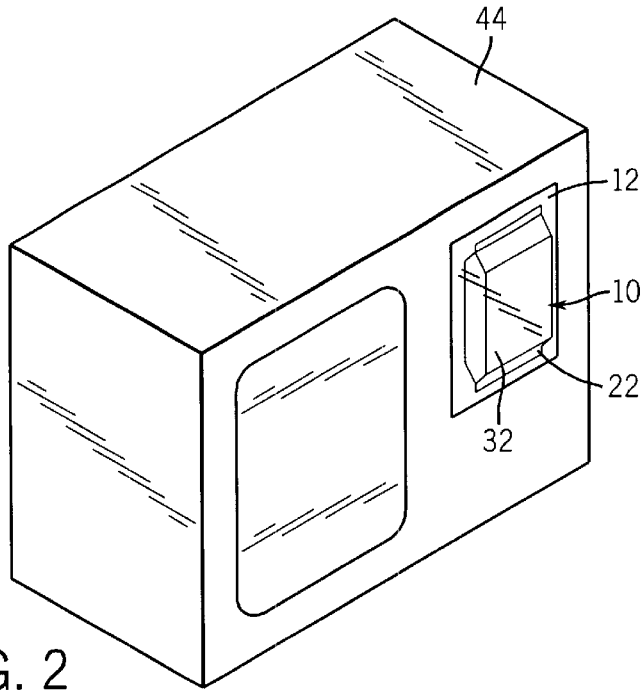
FIG. 2 is shows a pouch label adhered to a product package.

Referring to FIG. 3, in use the release liner 18 can be stripped by well-known automatic machines from the successive base layers 12 for automatic application to products on a conveyor line. The adhesive stays with the base layer bottom side 14 so that the label 10 may be attached to the outside of an item or packaging, such as a product 44 displayed for sale, as shown in FIG. 2.

Figure 4:
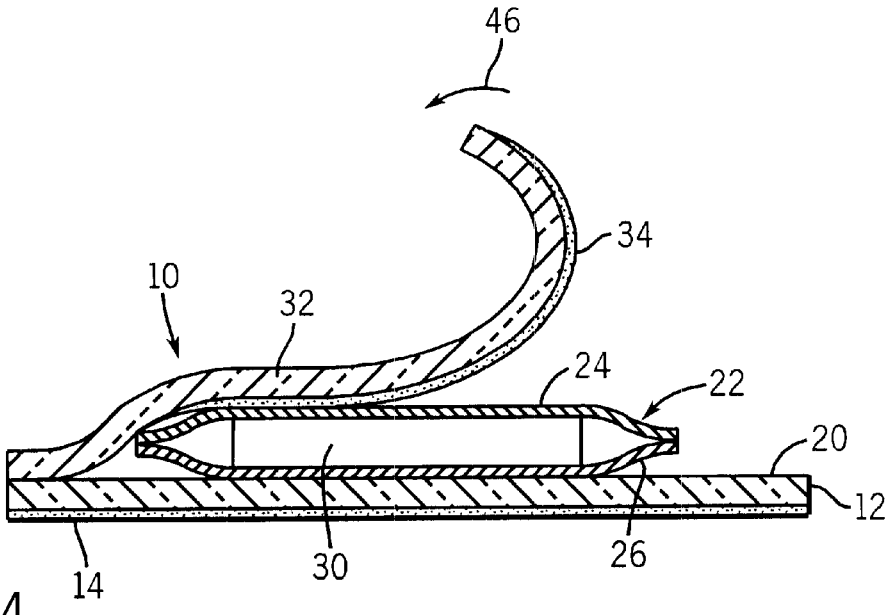
FIG. 4 is an end cross-sectional view similar to FIG. 3 with the pouch label removed from the release liner and the over-laminate being peeled away from the base layer to remove the pouch for use.

Referring to FIG. 4, the pouch 22 can be removed from the product 44 by removing the entire assembly, including the base layer 12, from the product, or by peeling back the over-laminate 32, as shown by arrow 46. This can be done by grasping an edge of the over-laminate 32 or by pulling the pouch 22 away from the base layer 12, for example, by a corner 36 (FIG. 1) not covered by the over-laminate 32.

If the over-laminate 32 sticks to the pouch 22 with too much tenacity, a line of perforations could be provided in the over-laminate along each side of the pouch 22, so that the central portion of the over-laminate 32 adhered to the pouch 22 could be separated along the perforations from the side portions of the over-laminate 32 which are adhered to the base layer 12.

Thus, the present invention provides a simple pouch label that can be used to easily attach product samples to items, such as products on display for sale. The label is comprised of common stock self-wound polymeric films and paper liners, and the labels can be assembled in a continuous line manner. Moreover, the base layer and over-laminate are transparent so as not to cover graphics on the pouch or the item to which it is attached.

While there has been shown and described what are at present considered to be the preferred embodiments of the invention, it will be obvious to those skilled in the art that various changes and modifications can be made to the described device without departing from the scope of the present invention. For example, other materials, such as cellophane tapes, paper, or foil sheets can be used for the various layers of the construction, and the base layer and over-laminate need not be transparent. Accordingly, to ascertain the full scope of the invention, reference must be had to the following claims.

What is claimed is:

1. A label for attaching a pouch to a surface, comprising:

a release liner;

a base layer having an adhesive bottom surface releasably adhered to the release liner;

a pouch supported by the base layer and defining a sealed envelope; and an over-laminate having an adhesive bottom surface adhered to the base layer on opposite sides of said pouch to secure the pouch to the base layer;

wherein the base layer can be removed from the release liner so as to adhere the pouch and over-laminate assembly to the surface and wherein the pouch can be removed from the pouch attachment assembly by separating at least a portion of the over-laminate from the base layer.

2. The label of claim 1, wherein the adhesive bottom surface of the over-laminate also adheres to the pouch.

3. The label of claim 1, wherein the width of the over-laminate is less than the width of the pouch.

4. The label of claim 3, wherein the width of the pouch is less than the width of the base layer.

5. The label of claim 1, wherein the over-laminate is transparent.

6. The label of claim 1, wherein the base layer is transparent.

7. The label of claim 1, wherein the base layer and over-laminate are a polymeric film.

8. A product sample display, comprising:

a product having a label attachment surface; and a sample label including:

a pouch containing the product sample;

a pouch attachment assembly having a base layer with an adhesive bottom adhered to the label attachment surface; and an over-laminate having an adhesive bottom surface adhered to the base layer on opposite sides of the pouch to secure the pouch to the base layer;

wherein the pouch can be removed from the pouch attachment assembly by separating at least a portion of the over-laminate from the base layer.

9. The display of claim 8, wherein the over-laminate is removably adhered to the pouch.

10. The display of claim 8, wherein the base layer is removably adhered to the label attachment surface of the product.

11. The display of claim 8, wherein the over-laminate and the base layer are transparent.

12. The display of claim 11, wherein the over-laminate and the base layer are polymeric films.

* * * * *